US011529645B2

(12) United States Patent
Fritz et al.

(10) Patent No.: US 11,529,645 B2
(45) Date of Patent: Dec. 20, 2022

(54) PERFORATED PLATE WITH A REDUCED DIAMETER IN ONE OR BOTH EDGE REGIONS OF A ROW OF NOZZLES

(71) Applicant: Dürr Systems AG, Bietigheim-Bissingen (DE)

(72) Inventors: Hans-Georg Fritz, Ostfildern (DE); Benjamin Wöhr, Eibensbach (DE); Marcus Kleiner, Besigheim (DE); Moritz Bubek, Ludwigsburg (DE); Timo Beyl, Besigheim (DE)

(73) Assignee: DÜRR SYSTEMS AG, Bietigheim-Bissingen (DE)

( * ) Notice: Subject to any disclaimer, the term of this patent is extended or adjusted under 35 U.S.C. 154(b) by 117 days.

(21) Appl. No.: 16/069,926

(22) PCT Filed: Jan. 13, 2017

(86) PCT No.: PCT/EP2017/000037
§ 371 (c)(1),
(2) Date: Jul. 13, 2018

(87) PCT Pub. No.: WO2017/121643
PCT Pub. Date: Jul. 20, 2017

(65) Prior Publication Data

US 2019/0022689 A1 Jan. 24, 2019

(30) Foreign Application Priority Data

Jan. 14, 2016 (DE) ..... 10 2016 000 356.1

(51) Int. Cl.
*B05B 17/00* (2006.01)
*B05B 1/14* (2006.01)
*B05C 5/02* (2006.01)

(52) U.S. Cl.
CPC ..... *B05B 17/0638* (2013.01); *B05B 1/14* (2013.01); *B05C 5/027* (2013.01); *B05C 5/0291* (2013.01)

(58) Field of Classification Search
CPC ..... B05B 17/0638; B05B 1/14; B05C 5/027; B05C 5/0291; B41J 2/2125; B41J 2202/11
See application file for complete search history.

(56) References Cited

U.S. PATENT DOCUMENTS 3,708,798 A 1/1973 Hildenbrand et al.
4,508,266 A 4/1985 Saito et al.
(Continued)

FOREIGN PATENT DOCUMENTS

CN 1176485 A 3/1998
CN 1242262 A 1/2000
(Continued)

OTHER PUBLICATIONS

WO-2014002770-A1 translation (Year: 2014).*
(Continued)

*Primary Examiner* — Steven M Cernoch
(74) *Attorney, Agent, or Firm* — Bejin Bieneman PLC

(57) ABSTRACT

The disclosure relates to a perforated plate for an application apparatus for the application of a fluid onto a component, preferably a motor vehicle bodywork and/or an add-on part therefor. The perforated plate comprises at least three through-holes for the passage of the fluid, wherein the through-holes are assigned to a row of nozzles with a central region and two edge regions, wherein the at least one outermost through-hole in at least one edge region has at least one reference opening diameter that is smaller than at least one reference opening diameter of at least one through-hole in the central region. The disclosure also relates to an
(Continued)

application apparatus and an application method with such a perforated plate.

21 Claims, 15 Drawing Sheets

(56) References Cited

U.S. PATENT DOCUMENTS

| | | | | |
|---|---|---|---|---|
| 4,622,239 | A | 11/1986 | Schoenthaler et al. | |
| 4,792,817 | A | 12/1988 | Barney | |
| 5,571,560 | A | 11/1996 | Lin | |
| 5,602,572 | A | 2/1997 | Rylander | |
| 5,699,491 | A | 12/1997 | Barzel | |
| 5,769,946 | A | 6/1998 | Kutsuzawa et al. | |
| 5,769,949 | A | 6/1998 | Cienkus et al. | |
| 5,818,477 | A | 10/1998 | Fullmer et al. | |
| 5,820,456 | A | 10/1998 | Nelson | |
| 6,062,056 | A | 5/2000 | Groch | |
| 6,096,132 | A | 8/2000 | Kaiba et al. | |
| 6,106,107 | A | 8/2000 | Sheinman | |
| 6,136,449 | A | 10/2000 | Furuuchi et al. | |
| 6,247,657 | B1 | 6/2001 | Finney, Jr. | |
| 6,264,547 | B1 | 7/2001 | Waelti | |
| 6,302,523 | B1 | 10/2001 | Smith | |
| 6,325,490 | B1 | 12/2001 | Yang | |
| 6,331,326 | B1 | 12/2001 | Tsunoda et al. | |
| 6,375,319 | B1 | 4/2002 | Kamano et al. | |
| 6,428,132 | B1 | 8/2002 | Kubatzki et al. | |
| 6,517,187 | B1 | 2/2003 | Dietl et al. | |
| 6,592,203 | B1 | 7/2003 | Bates et al. | |
| 6,764,162 | B2 | 7/2004 | Biddle et al. | |
| 7,182,815 | B2 | 2/2007 | Katagami et al. | |
| 7,625,065 | B2 * | 12/2009 | Kanda | B41J 2/1433 347/15 |
| 7,857,423 | B2 | 12/2010 | Suzuki | |
| 8,567,909 | B2 | 10/2013 | Sieber | |
| 9,085,151 | B2 * | 7/2015 | Iriguchi | B41J 2/2125 |
| 2002/0155069 | A1 | 10/2002 | Pruche | |
| 2002/0166232 | A1 | 11/2002 | Fujita et al. | |
| 2002/0175962 | A1 | 11/2002 | Otsuki | |
| 2003/0029379 | A1 | 2/2003 | Onogawa et al. | |
| 2003/0048314 | A1 | 3/2003 | Renn | |
| 2003/0155451 | A1 | 8/2003 | Hisashi et al. | |
| 2003/0159651 | A1 | 8/2003 | Sakurada | |
| 2003/0186613 | A1 | 10/2003 | Kawase | |
| 2003/0202215 | A1 | 10/2003 | Biddle et al. | |
| 2004/0165021 | A1 | 8/2004 | Desie | |
| 2005/0048897 | A1 | 3/2005 | Tong | |
| 2005/0156960 | A1 | 7/2005 | Courian et al. | |
| 2005/0179724 | A1 | 8/2005 | Salt et al. | |
| 2005/0189442 | A1 | 9/2005 | Hussaini | |
| 2006/0044376 | A1 | 3/2006 | Baird et al. | |
| 2006/0068109 | A1 | 3/2006 | Frankenberger et al. | |
| 2006/0103691 | A1 | 5/2006 | Dietl et al. | |
| 2006/0171250 | A1 | 8/2006 | Frosztega et al. | |
| 2006/0197723 | A1 | 9/2006 | Sikora et al. | |
| 2007/0034715 | A1 | 2/2007 | Clifford | |
| 2007/0062383 | A1 | 3/2007 | Gazeau et al. | |
| 2007/0076069 | A1 | 4/2007 | Edwards et al. | |
| 2007/0097176 | A1 | 5/2007 | Hickey et al. | |
| 2007/0146399 | A1 | 6/2007 | Yamamoto | |
| 2008/0047486 | A1 | 2/2008 | Herre et al. | |
| 2008/0236484 | A1 | 10/2008 | Herre et al. | |
| 2008/0252671 | A1 | 10/2008 | Cannell et al. | |
| 2008/0311836 | A1 | 12/2008 | Bhattacharya | |
| 2009/0002441 | A1 | 1/2009 | Yoshiro et al. | |
| 2009/0057445 | A1 * | 3/2009 | Hung | F02M 61/1853 239/533.12 |
| 2009/0284570 | A1 | 11/2009 | Jung et al. | |
| 2010/0047465 | A1 | 2/2010 | Ansorge et al. | |
| 2010/0051071 | A1 | 3/2010 | Calhoun et al. | |
| 2010/0079543 | A1 | 4/2010 | Otokita | |
| 2010/0231644 | A1 | 9/2010 | Otokita | |
| 2011/0052819 | A1 | 3/2011 | Ebisawa | |
| 2011/0262622 | A1 | 10/2011 | Herre et al. | |
| 2013/0222454 | A1 | 8/2013 | Iriguchi | |
| 2015/0211461 | A1 * | 7/2015 | Shirk | F02M 61/1833 239/557 |
| 2015/0375241 | A1 | 12/2015 | Wohr et al. | |

FOREIGN PATENT DOCUMENTS

| | | | |
|---|---|---|---|
| CN | 1651898 | A | 8/2005 |
| CN | 1668386 | A | 9/2005 |
| CN | 101711186 | A | 5/2010 |
| CN | 102021753 | A | 4/2011 |
| CN | 102294317 | A | 12/2011 |
| CN | 103402726 | A | 11/2013 |
| CN | 104040276 | A | 9/2014 |
| CN | 104994963 | A | 10/2015 |
| DE | 1887910 | U | 2/1964 |
| DE | 3130096 | A1 | 5/1982 |
| DE | 3140486 | A1 | 5/1982 |
| DE | 3927880 | A1 | 1/1991 |
| DE | 4204704 | A1 | 8/1993 |
| DE | 4238378 | A1 | 5/1994 |
| DE | 29614871 | U1 | 12/1996 |
| DE | 19734485 | A1 | 2/1998 |
| DE | 19731829 | A1 | 1/1999 |
| DE | 19852079 | A1 | 5/2000 |
| DE | 29724351 | U1 | 12/2000 |
| DE | 102004044655 | A1 | 3/2006 |
| DE | 102006005341 | A1 | 8/2007 |
| DE | 60218929 | T2 | 12/2007 |
| DE | 102006032804 | A1 | 1/2008 |
| DE | 102006047382 | A1 | 4/2008 |
| DE | 102006060398 | A1 | 6/2008 |
| DE | 202011001109 | U1 | 3/2011 |
| DE | 10 2010 019 612 | A1 | 11/2011 |
| DE | 102011056823 | A1 | 6/2013 |
| DE | 10 2013 002 413 | A1 | 8/2014 |
| EP | 0026359 | A2 | 4/1981 |
| EP | 0206452 | A2 | 12/1986 |
| EP | 0538147 | A2 | 4/1993 |
| EP | 0970811 | A1 | 1/2000 |
| EP | 1065055 | A1 | 1/2001 |
| EP | 1095707 | A2 | 5/2001 |
| EP | 1253626 | A2 | 10/2002 |
| EP | 1277579 | A2 | 1/2003 |
| EP | 1449667 | A1 | 8/2004 |
| EP | 1884365 | A1 | 2/2008 |
| EP | 2208541 | A2 | 7/2010 |
| FR | 2514267 | A1 | 4/1983 |
| FR | 2862563 | A1 | 5/2005 |
| GB | 2107614 | A | 5/1983 |
| GB | 2177946 | A | 2/1987 |
| JP | S53-126930 | A | 11/1978 |
| JP | S5625465 | A | 3/1981 |
| JP | H03151073 | A | 6/1991 |
| JP | 04063163 | A | 2/1992 |
| JP | H06121944 | A | 5/1994 |
| JP | H0679506 | U | 11/1994 |
| JP | H0737797 | A | 2/1995 |
| JP | H08274014 | A | 10/1996 |
| JP | H09075825 | A | 3/1997 |
| JP | 0994527 | A | 4/1997 |
| JP | H09164706 | A | 6/1997 |
| JP | H10083982 | A | 3/1998 |
| JP | H10197967 | A | 7/1998 |
| JP | 11076889 | A | 3/1999 |
| JP | 2000033289 | A | 2/2000 |
| JP | 2000135459 | A | 5/2000 |
| JP | 2000238254 | A | 9/2000 |
| JP | 2002096474 | A | 4/2002 |
| JP | 2003103791 | A | 4/2003 |
| JP | 2003117460 | A | 4/2003 |
| JP | 2003144991 | A | 5/2003 |
| JP | 2003165226 | A | 6/2003 |
| JP | 2003-329828 | A | 11/2003 |
| JP | 2004066081 | A | 3/2004 |
| JP | 2005028227 | A | 2/2005 |
| JP | 2005-088548 | A | 4/2005 |
| JP | 2005254210 | A | 9/2005 |
| JP | 2006-289239 | A | 10/2006 |

(56) References Cited

FOREIGN PATENT DOCUMENTS

| | | | | |
|---|---|---|---|---|
| JP | 2007154431 | A | 6/2007 | |
| JP | 2008-246713 | A | 10/2008 | |
| JP | 201040323 | A | 2/2010 | |
| JP | 2010076362 | A | 4/2010 | |
| JP | 2011049002 | A | 3/2011 | |
| JP | 2011526832 | A | 10/2011 | |
| JP | 2011230410 | A | 11/2011 | |
| JP | 2013180437 | A | 9/2013 | |
| JP | 2014502920 | A | 2/2014 | |
| JP | 2015506412 | A | 3/2015 | |
| JP | 2016513003 | A | 5/2016 | |
| JP | 5976320 | B2 | 8/2016 | |
| JP | 2016175077 | A | 10/2016 | |
| JP | 6130950 | B2 | 5/2017 | |
| WO | 88/08755 | A1 | 11/1988 | |
| WO | 9632282 | A1 | 10/1996 | |
| WO | 98/28088 | A2 | 7/1998 | |
| WO | 01/15812 | A1 | 3/2001 | |
| WO | 2007131636 | A1 | 11/2007 | |
| WO | 2008125967 | A2 | 10/2008 | |
| WO | 2008128019 | A1 | 10/2008 | |
| WO | 2010146473 | A1 | 12/2010 | |
| WO | WO-2014002770 | A1 * | 1/2014 | ..... A61M 15/025 |
| WO | 2014121926 | A1 | 8/2014 | |

OTHER PUBLICATIONS

Article: New Sprayers Make Car Body Painting More Economical, 2004; 4 pages (inlcuding abstract).

International Search Report for PCT/EP2009/007448, dated Jan. 29, 2010.

"Types of Residential Plumbing Systems". Oct. 8, 1999. Web. Sep. 2, 2014; <<http://www.chilipperapp.com/ps.htm>>.

Obst, Manfred "Lackierereien planen und optimieren", Moderne Lackiertechnik, p. 41, 2002, ISBN: 3878707371.

EPO Office Action dated Feb. 7, 2018 for Application No. EP16 001 687.9 (4 pages).

SIPO Office Action dated Feb. 1, 2018 for Application No. CN20161044566.2 (7 pages; with English translation).

SIPO Office Action dated Dec. 14, 2017 for Application No. 201610445627.7 (6 pages; with English translation).

Non-Final Office Action for U.S. Appl. No. 15/911,580 dated Jun. 28, 2019 (11 pages).

International Search Report and Written Opinion for PCT/EP2017/000038 dated Mar. 24, 2017 (16 pages; with English translations).

International Search Report and Written Opinion for PCT/EP2017/000037 dated Apr. 21, 2017 (16 pages; with English translations).

China National Intellectual Property Administration Search Report for CN 201780013200.2 dated Mar. 30, 2020 (2 pages; English translation only).

Non-Final Office Action for U.S. Appl. No. 16/069,907 dated Aug. 28, 2020 (57 pages).

Kyle Puccie; "What Causes Wetting?"; Aug. 3, 2018; Internet Article from Imageexpert.com; 5 pages (year: 2018).

USPTO Final Office Action dated Feb. 9, 2021 for U.S. Appl. No. 16/069,907 (11 pages).

Notification of Reasons for Rejection from the Japanese Patent Office for JP2018536725 dated Sep. 15, 2020 (8 pages).

Notification of Reasons for Rejection from the Japanese Patent Office for JP2018536731 dated Sep. 15, 2020 (9 pages).

EPO Office Action for EP 17700769.7-1010 dated Nov. 19, 2019 (3 pages).

Chinese Office Action for Application No. CN201780013202.1 dated Mar. 30, 2020 (8 pages).

European Examination Report for EP17700769.7 dated Jul. 22, 2020 (3 pages; English translation not available).

CIPO Office Action dated Jul. 23, 2021 for Application No. CN201780013200.2 (17 pages; with English translation).

* cited by examiner

PERFORATED PLATE WITH A REDUCED DIAMETER IN ONE OR BOTH EDGE REGIONS OF A ROW OF NOZZLES

CROSS-REFERENCE TO RELATED APPLICATIONS

This application is a national stage of, and claims priority to, Patent Cooperation Treaty Application No. PCT/EP2017/000037, filed on Jan. 13, 2017, which application claims priority to German Application No. DE 10 2016 000 356.1, filed on Jan. 14, 2016, which applications are hereby incorporated herein by reference in their entireties.

BACKGROUND

The disclosure concerns a perforated plate (e.g. cover) for an application device (e.g. applicator) for application of a fluid to a component, in particular a motor vehicle body and/or an attachment for this. The disclosure furthermore concerns an application device and an application method in which such a perforated plate is used.

DE 10 2013 002 413 A1 discloses a perforated plate for an applicator for application of a coating medium in particular without overspray. The perforated plate here comprises several through-holes for application of the coating medium, wherein the through-holes are arranged in several nozzle rows in a matrix pattern and hence in a two-dimensional configuration. In this way, sharp-edged coating medium tracks can be produced. The disadvantage however is that the sharp-edged coating tracks are unsuitable for overlapping since they have an at least approximately rectangular cross-sectional profile. FIG. 16 shows for example an almost perfect joint between two coating medium tracks B1* and B2* with a rectangular cross-sectional profile. Such a perfect joint should have a variance of +/−50 μm, which would lead to the optimum coating shown on the right in FIG. 16. Such a perfect joint is not possible in practice, or only possible at substantial cost, for example because of tolerances. FIG. 17 shows two coating medium tracks B1* and B2* with rectangular cross-sectional profile, which do not touch or overlap in the joint/overlap region, which leads to a disadvantageous indentation in the resulting coating, as shown on the right in FIG. 17. FIG. 18 shows two coating medium tracks B1* and B2* with rectangular cross-sectional profile which overlap in the joint/overlap region so that an over-coating occurs, which leads to a disadvantageous peak or protrusion in the resulting coating, as shown on the right in FIG. 18.

DE 10 2010 019 612 A1 discloses an application device which provides a cross-sectional profile in the form of a trapezium, which is more suitable for overlapping of coating tracks. The trapezoid profile is produced by several through-holes for application of the coating medium, wherein the through-holes are arranged in several nozzle rows in a matrix pattern and hence in a two-dimensional configuration. Differently sized nozzle diameters, distributed regularly or superficially, serve in particular to achieve a better resolution with a superficial coating. The two-dimensional configuration with nozzle diameters of the same or different sizes, and the resulting trapezoid profile, firstly have a high complexity because of the plurality of through-holes. In addition, the two-dimensional configuration gives an undesirably high flow of coating medium, in particular when the coating medium is applied continuously as is usual when painting vehicle bodywork. The two-dimensional configuration also means that, on application of a coating track, coating medium from a nozzle row arranged downstream relative to the movement direction is applied on top of coating medium from a nozzle row arranged upstream in the movement direction, which disadvantageously can lead to coating medium splashes because coating medium is applied onto coating medium which has not yet dried or set sufficiently. U.S. Pat. Nos. 4,622,239 A and 5,769,946 A may also be cited as the general prior art.

DETAILED DESCRIPTION

Figure 1:
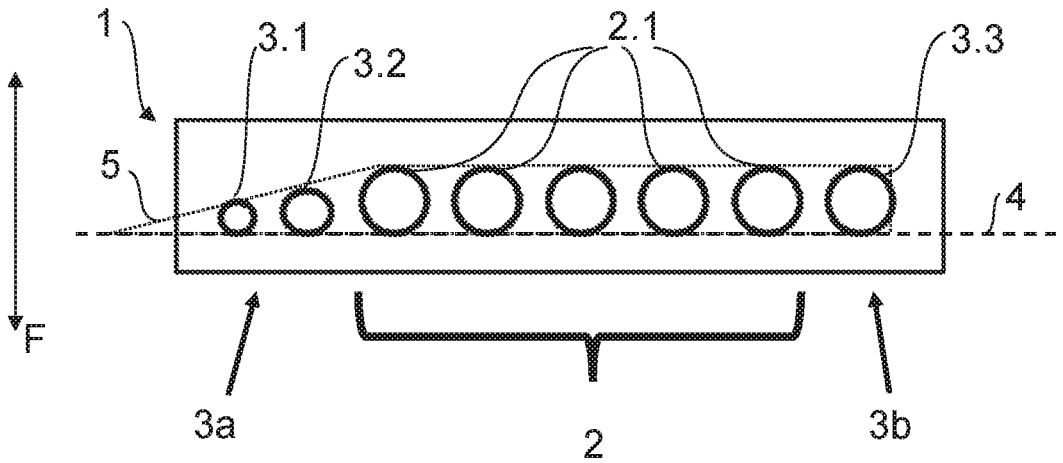
FIG. 1 shows a perforated plate with a row of nozzles according to one example of the disclosure.

The disclosure creates an improved and/or alternative perforated plate, in particular a perforated plate which allows an improved joint or overlap region of two fluid tracks and/or a fluid application which is at least substantially free from fluid splashes.

The disclosure provides a perforated plate (e.g. cover, strip, chip etc.) for an application device (e.g. an applicator) for application of a fluid to a component, in particular a motor vehicle body and/or an attachment for this.

The perforated plate and/or the application device serves in particular for application of the fluid without atomisation and/or masking.

The fluid may e.g. be a coating medium, in particular a paint, a sealant, a separating agent, a function layer or an adhesive.

The fluid preferably has a viscosity of more than 50 mPas, more than 80 mPas or even more than 100 mPas, in particular measured with a shear rate of 1000 $s^{-1}$. The fluid may have a Newtonian or non-Newtonian flow behaviour.

The perforated plate preferably has at least three, at least four or at least five through-holes for the passage of the fluid. The through-holes are suitably arranged in a preferably substantially linearly oriented row of nozzles, wherein the row of nozzles has two edge regions and a central region, suitably extending between the two edge regions.

The perforated plate is distinguished in particular in that the at least one outermost through-hole in at least one edge region has at least one reference opening diameter that is smaller than at least one reference opening diameter of at least one through-hole in the central region, so that preferably a fluid application (e.g. fluid track) with a substantially trapezoid cross-sectional profile can be enabled, for example, a substantially right-angled, isosceles or non-isosceles trapezoid cross-sectional profile and/or a substantially Gaussian curve-shaped cross-sectional profile. In the context of the disclosure, it is possible that the at least two, at least three or even at least four outermost through-holes in at least one edge region suitably have uniform or non-uniform reference opening diameters that are smaller than at least one reference opening diameter of at least one through-hole in the central region.

The at least one outermost through-hole corresponds particularly to the first through-hole from the outside of the row of nozzles in the at least one edge region.

The at least two, at least three and/or at least four outermost through-holes correspond in particular to the two, three and/or four first through-holes from the outside of the row of nozzles in the at least one edge region.

In the context of the disclosure, in a particularly linearly oriented row of nozzles, a reference opening diameter of at least one through-hole in at least one of the two edge regions can be smaller than the reference opening diameters of the preferably plural through-holes in the central region between the two edge regions. It should also be mentioned, however, that in one example of the disclosure, the central region can also suitably have only one single through-hole.

The gradation and thus the suitable diameter reduction of the reference opening diameter can take place for just the outermost and thus, from the outside, the first through-hole in just one edge region or both edge regions.

However, the gradation and thus the suitable diameter reduction of the reference opening diameter can also take place over the at least two, at least three and/or at least four outermost and thus at least two, at least three and/or at least four, of the first through-holes from the outside in just one edge region or both edge regions.

With a diameter reduction in just one edge region, for example, a fluid application (e.g. fluid track) can be created with a substantially right-angled trapezium cross-sectional profile.

With a diameter reduction in both edge regions, for example, a fluid application (e.g. fluid track) can be created with a substantially isosceles or non-isosceles trapezium cross-sectional profile.

In particular, the disclosure allows an improved distribution of layer thickness in the joint or overlap region of two fluid applications (e.g. fluid tracks), which leads to visually uniform fluid surfaces (e.g. coating surfaces), suitably without fluctuations in layer thickness which would disadvantageously be perceptible to the human eye. Alternatively or additionally, the disclosure allows in particular that, by application of the fluid from preferably just a single nozzle row and hence in a one-dimensional nozzle configuration, application splashes are reduced or fully avoided because the nozzle row applies the fluid directly to the component, in some cases with the exception of a possible joint or overlap region of two fluid applications, wherein in the joint or overlap region the previously applied fluid has however usually already dried or hardened sufficiently and hence no longer has a tendency—or at least has only a greatly reduced tendency—to form fluid splashes.

By means of the perforated plate according to the disclosure, a spacing tolerance between two suitably sharp-edged fluid applications (e.g. fluid tracks) can be achieved of up to +/−150 μm, +/−200 μm, +/−500 μm, +/−1 mm or even +/−2 mm.

It is possible that the perforated plate has only a single nozzle row for application of the fluid, so that a one-dimensional nozzle configuration is possible.

The row of nozzles may include the central region and at least one edge region can be aligned e.g. linearly along an alignment line (suitably a straight alignment line) linearly.

It is even possible that all the through-holes of the row of nozzles are aligned, for example, linearly along the alignment line.

All the through-holes of the row of nozzles may be aligned linearly along one and the same alignment line.

The alignment line can extend, for example, through at least one reference opening diameter and/or hole outlet diameter of the at least one outermost through-hole or the at least two outermost through-holes in at least one edge region and at least one reference through opening diameter and/or hole outlet diameter of at least one through-hole in the central region, so that preferably a, for example, one-sided off-centre nozzle row alignment comes about between the at least one edge region and the central region. In an example of the disclosure, the alignment line can even extend through all the reference opening diameters and/or hole outlet diameters of the row of nozzles.

The alignment line can herein therefore correspond to a tangent to the reference opening diameters and/or the hole outlet diameters, in relation to all the through-holes of the row of nozzles.

The nozzle row arrangement can either be aligned as e.g. "top aligned", "bottom aligned" or "vertically centred".

The alignment line may also extend, for example, through at least one central axis of the at least one outermost through-hole or the at least two outermost through-holes in at least one edge region and at least one central axis of at least one through-hole in the central region, so that a central nozzle row alignment comes about between the at least one edge region and the central region. In a preferred example of the disclosure, the alignment line can even extend through all the central axes of the row of nozzles.

It is possible that at least one central axis of the outermost through-hole or of the at least two outermost through-holes in at least one edge region is arranged closer to the alignment line than at least one central axis of at least one through-hole in the central region. Alternatively or additionally, e.g. at least one central axis of the outermost through-hole or of the at least two outermost through-holes in at least one edge region and at least one central axis of at least one through-hole in the central region can be aligned substantially on the alignment line.

It is possible that the at least two, at least three or/or at least four outermost through-holes in at least one edge region have reference opening diameters that are smaller than at least one reference opening diameter of at least one through-hole in the central region.

The reference opening diameters of the through-holes in the at least one edge region can preferably be configured uniform (e.g. substantially equal-sized) or non-uniform (e.g. differently sized) in relation to one another.

The at least one outermost through-hole in at least one edge region can preferably have the smallest reference opening diameter of the row of nozzles. In the context of the disclosure, it is hereby possible, in particular, that the outermost through-hole has the absolute smallest reference opening diameter of the row of nozzles or at least a further through-hole of the row of nozzles has a (e.g. substantially equal-sized) reference opening diameter that is uniform therewith, provided suitably that none has a smaller reference opening diameter.

It is possible that the at least two outermost through-holes in at least one edge region have a uniform (e.g. substantially equal-sized) or different sized reference opening diameter.

In an example of the disclosure, the at least two outermost through-holes can have a different reference opening diameter in at least one edge region, wherein the reference opening diameter of the outermost through-hole can be the smaller reference opening diameter.

The central region can preferably have at least two, at least three or at least four through-holes. Alternatively or additionally, at least one edge region can have at least two, at least three or at least four through-holes.

It is possible that a plurality, preferably all, of the through-holes in the central region have a uniform (suitably substantially equal-sized) reference opening diameter, the central axes of a plurality, preferably all the through-holes in the central region are aligned linearly to one another, and/or a plurality, preferably all, of the through-holes are spaced equally from one another in the central region.

In an example of the disclosure, all the through-holes in the central region have a uniform (suitably substantially equal-sized) reference opening diameter and/or are spaced substantially equally from one another.

It is possible that at least two hole spacings between at least three through-holes in the central region are configured uniformly (suitably substantially equal-sized).

In an example of the disclosure, the row of nozzles can be configured overall with uniform (suitably substantially equal-sized) hole spacings between the through-holes.

It is possible that the outermost hole spacing or the at least two outermost hole spacings in at least one edge region correspond to the at least one hole spacing in the central region and thus are preferably configured substantially equal-sized.

It is also possible that the outermost hole spacing or the at least two outermost hole spacings in at least one edge region are smaller or larger than the at least one hole spacing in the central region.

It is also possible that the outermost hole spacing or the at least two outermost hole spacings in one edge region of the row of nozzles is configured uniform (suitably substantially equal-sized) or non-uniform (suitably differently sized) relative to the outermost hole spacing or the at least two outermost hole spacings in the other edge region.

The through-hole configurations in the two edge regions can correspond to one another (e.g. substantially identical and/or axially symmetrical, e.g. to the centre of the row of nozzles) or can be configured differently. The through-hole configurations herein preferably comprise the formation of the through-holes, the reference opening diameter and/or the hole spacings.

The reference opening diameters can be, in particular, hole outlet diameters.

It is possible that at least one through-hole in the central region of the row of nozzles and/or at least one through-hole in at least one edge region of the row of nozzles has a hopper-shaped hole inlet opening and preferably a cylindrical hole outlet opening. The hopper-shaped hole inlet opening preferably narrows in the flow direction of the fluid.

The hopper-shaped hole inlet opening of the at least one through-hole in the central region can, for example, extend deeper into the perforated plate than the hopper-shaped hole inlet opening of the at least one through-hole in the at least one edge region. Alternatively or additionally, an inlet cross-section (e.g. of the inlet-side passage cross-section) of a hole inlet opening of at least one through-hole in the central region of the row of nozzles can be larger than an inlet cross-section (e.g. of the inlet-side passage cross-section) of a hole inlet opening of at least one through-hole in at least one edge region of the row of nozzles.

The row of nozzles can be configured, in particular, to form a fluid application (e.g. a fluid track), with a substantially trapezoid cross-sectional profile, e.g. a substantially right-angled, isosceles or non-isosceles trapezoid cross-sectional profile and/or a cross-sectional profile with substantially Gaussian curve shape, so that the row of nozzles is suitable, in particular, for generating fluid tracks, which are optimised for overlap.

It is possible that at least one through-hole has, over its length, a constant, in particular unchanging, passage cross-section. The reference opening diameter then preferably relates to the one suitably constant opening diameter of the unchanging passage cross-section. This is the case, for example, if the through-hole is configured, for example, cylindrical, in particular circular cylinder-shaped. It is alternatively or additionally possible that at least one through-hole has, over its length, a changing passage cross-section. The reference opening diameter then preferably relates to the smallest opening diameter of the changing passage cross-section. This is the case, for example, if the through-hole is configured, for example, cylindrical, in particular circular cylinder-shaped, but the hole outlet opening has a larger passage cross-section than the hole inlet opening or vice versa or the through-hole is configured, for example, substantially Laval nozzle-shaped.

The reference opening diameters therefore preferably relate to an at least substantially constant opening diameter and/or to the smallest opening diameter of the associated through-hole, preferably a hole outlet opening diameter.

In one example, the hole inlet opening has a larger passage cross-section than the hole outlet opening. The hole inlet opening can be configured, for example, hopper-shaped.

It is possible that the two edge regions are formed symmetrically or asymmetrically or that the row of nozzles is configured symmetrically overall, in particular, axially symmetrically and/or mirror symmetrically relative to a symmetry axis extending transversely to the row of nozzles.

The at least one outermost through-hole in one edge region can have, for example, at least a reference opening diameter that is smaller than at least one reference opening diameter of at least one through-hole in the central region, wherein the at least one outermost through-hole in the other edge region can have at least a reference opening diameter which is configured uniform (e.g. substantially equal-sized) relative to at least a reference opening diameter of at least one through-hole in the central region.

The disclosure is not restricted to a perforated plate, but also comprises an application device, e.g. an applicator, for applying a fluid, wherein the application device has at least one perforated plate as disclosed herein.

It is possible that the application device is configured to ensure a fluid inflow with equal pressure over the entire row of nozzles and thus over suitably all the through-holes, so that preferably by means of the through-hole or holes with a smaller reference opening diameter, as a result of the pressure loss, there flows a smaller fluid volume flow.

It is also possible that the application device is configured to guarantee a fluid inflow in the at least one edge region which can be controlled (e.g. regulated) independently of the central region.

The two edge regions may e.g. be supplied with fluid by the same fluid delivery unit or each have their own fluid delivery unit, so that in particular each edge region can be supplied with fluid via a separately controllable (e.g. regulatable) fluid delivery unit.

The application device serves preferably for application of a fluid with a viscosity of over 50 mPas, over 80 mPas or over 100 mPas, in particular at a shear rate of 1000 $s^{-1}$. The fluid may have a Newtonian or a non-Newtonian flow behaviour.

It is possible that the application device has at least two perforated plates arranged next to each other, the nozzle rows of which are preferably arranged offset to each other in the longitudinal direction of the nozzle rows.

The at least one perforated plate may in particular be arranged at (e.g. on or in) an outer end face of the application device, and thus preferably constitute an outer plate. The at least three through-holes consequently preferably form outlet holes from the application device.

The disclosure furthermore comprises an application method for application of a fluid by means of at least one application device and/or at least one perforated plate as disclosed herein.

In particular, it is possible that the fluid is applied from one single nozzle row of the perforated plate.

It should be mentioned that the fluid is preferably a coating medium, e.g. a paint, a sealant, a separating agent, an adhesive etc., and/or may serve to form a function layer.

The category of function layer includes in particular layers which lead to a surface functionalisation, such as e.g. adhesion-promoting agents, primers or layers to reduce transmission.

In the context of the disclosure, it is possible to supplement the perforated plate as described herein with features from WO 2014/121926 A1, in particular its claims, so that the full content of this patent application is to be included to the present disclosure.

The perforated plate according to the disclosure may in particular have hole inlet openings on the upstream side of the perforated plate and hole outlet openings on the downstream side of the perforated plate, and e.g. three-dimensional structurings on the upstream side of the perforated plate and/or on the downstream side of the perforated plate.

It is possible that the hole inlet openings are fluidically optimised, in particular nozzle-shaped, and/or that the hole inlet openings have a larger (passage) cross-section than the hole outlet openings.

It is possible that pipe stubs serve as structurings, which protrude from the downstream side of the perforated plate and into which the through-holes transform, in order in particular to reduce the wetting surface area at the hole outlet openings.

The pipe stubs may e.g. have an outer casing surface which tapers, in particular conically, towards the free end of the respective pipe stub.

The perforated plate may e.g. have a greater thickness at the edge than in a central region with the through-holes.

It is possible that preferably all through-holes in the perforated plate are produced at least partially by an etching production method, in particular dry etching or wet etching.

The perforated plate may in particular consist at least partially of a semiconductor material, e.g. one of the following materials: silicon, silicon dioxide, silicon carbide, gallium, gallium arsenide and/or indium phosphide.

It should be mentioned that, in the context of the disclosure, the feature of a substantially trapezoid cross-sectional profile may preferably comprise also e.g. a cross-sectional profile with substantially Gaussian curve shape.

The examples described with reference to the figures partially correlate, so that similar or identical parts are identified with the same reference signs and for their explanation, reference is also made, for the avoidance of repetition, to the description of one or more other examples.

FIG. 1 shows a perforated plate 1 for an application device for preferably atomisation-free and masking-free application of a fluid onto a component, for example, a motor vehicle body and/or an attachment therefor.

The perforated plate 1 comprises a central region 2 with a plurality of through-holes 2.1 of which for the sake of clarity, only three are provided with the reference sign 2.1. The perforated plate 1 also comprises a first left edge region **3*a* in FIG. 1 with two through-holes 3.1 and 3.2 and a second right edge region 3*b* in FIG. 1 with a through-hole 3.3. The through-holes 2.1, 3.1, 3.2 and 3.3** form a linearly aligned row of nozzles and serve to conduct the fluid through.

The through-holes 2.1, 3.1, 3.2 and 3.3 each have a passage cross-section that is preferably unchanging, e.g. substantially cylindrical, over their length, so that their opening diameters are suitably substantially constant.

The two outermost through-holes 3.1 and 3.2 and therefore the two first through-holes 3.1 and 3.2 from the outside in the first edge region **3*a* have a reference opening diameter that is smaller than the reference opening diameter of the through-holes 2.1 in the central region 2**.

The perforated plate 1 comprises only one single row of nozzles, wherein the row of nozzles is aligned linearly along a straight alignment line 4.

In the perforated plate 1 shown in FIG. 1, the alignment line 4 extends linearly through the reference opening diameter of the two outermost through-holes 3.1 and 3.2 in the edge region 3*a* and the reference opening diameter in the central region 2 so that an off-centre nozzle row alignment comes about between the edge region 3*a* and the central region 2. The central axes of the through-holes 3.1 and 3.2 in the first edge region 3*a* are arranged closer to the alignment line 4 than the central axes of the through-holes 2.1 in the central region 2.

The through-holes 2.1 in the central region 2 all have the same reference opening diameter and are equally spaced from one another.

In the example shown in FIG. 1, the two outermost through-holes 3.1 and 3.2 of the first edge region 3*a* have a different reference opening diameter, wherein the outermost through-hole 3.1 in the first edge region 3*a* has the smallest reference opening diameter of the row of nozzles.

With the perforated plate 1 shown in FIG. 1, only the first edge region 3*a* has a reduced reference opening diameter relative to the central region 2, whereas the second edge region 3*b* and the central region 2 have substantially equal-sized reference opening diameters. The two edge regions 3*a* and 3*b* are therefore not uniformly configured.

The hole spacings of the row of nozzles are substantially equal-sized with the exception of the outermost hole spacing between the through-holes 3.1 and 3.2, which is smaller than the remaining hole spacings of the row of nozzles.

The outer periphery of the row of nozzles can be delimited by a substantially right-angled trapezium 5. The row of nozzles thus generates a fluid track with a substantially right-angled trapezium cross-sectional profile.

The double arrow F indicates the two possible movement directions of the perforated plate 1 relative to the component.

Figure 2:
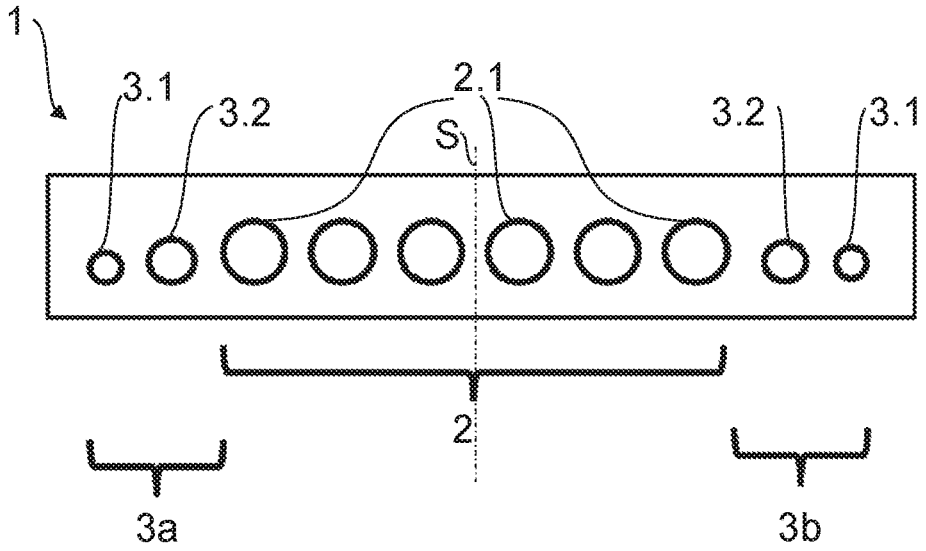
FIG. 2 shows a perforated plate with a row of nozzles according to another example of the disclosure.

FIG. 2 shows a perforated plate 1 according to another example of the disclosure.

With the perforated plate 1 shown in FIG. 2, the gradation and thus the reduction of the reference opening diameters takes place in both edge regions 3*a* and 3*b*.

The first edge region 3*a* and the second edge region 3*b* have a uniform, in particular axially symmetrical nozzle hole configuration.

With the example shown in FIG. 2, the row of nozzles is configured symmetrically overall, in particular, axially symmetrically and/or mirror symmetrically relative to a symmetry axis S extending transversely to the row of nozzles.

Figure 3:
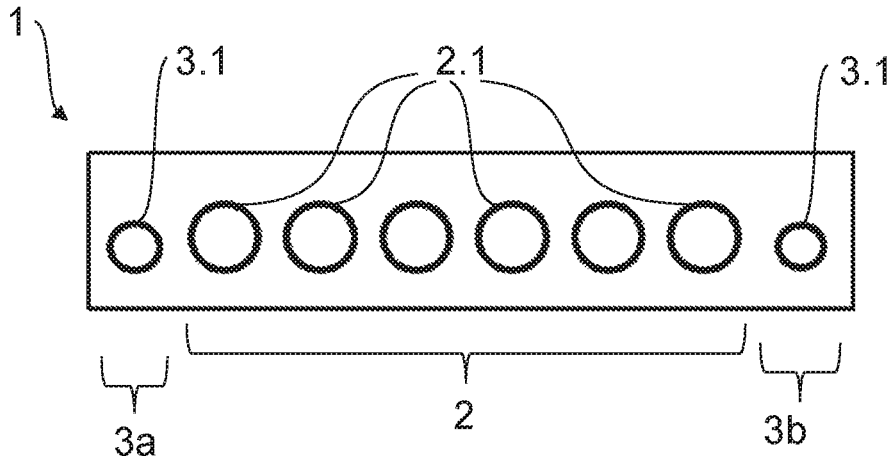
FIG. 3 shows a perforated plate with a row of nozzles according to yet another example of the disclosure.

FIG. 3 shows a perforated plate 1 according to yet another example of the disclosure.

With the perforated plate 1 shown in FIG. 3, the reduction of the reference opening diameters takes place in both edge regions 3*a* and 3*b*. However, the two edge regions 3*a* and 3*b* do not include two through-holes each as in FIG. 2, but only one through-hole 3.1 each.

Figure 4:
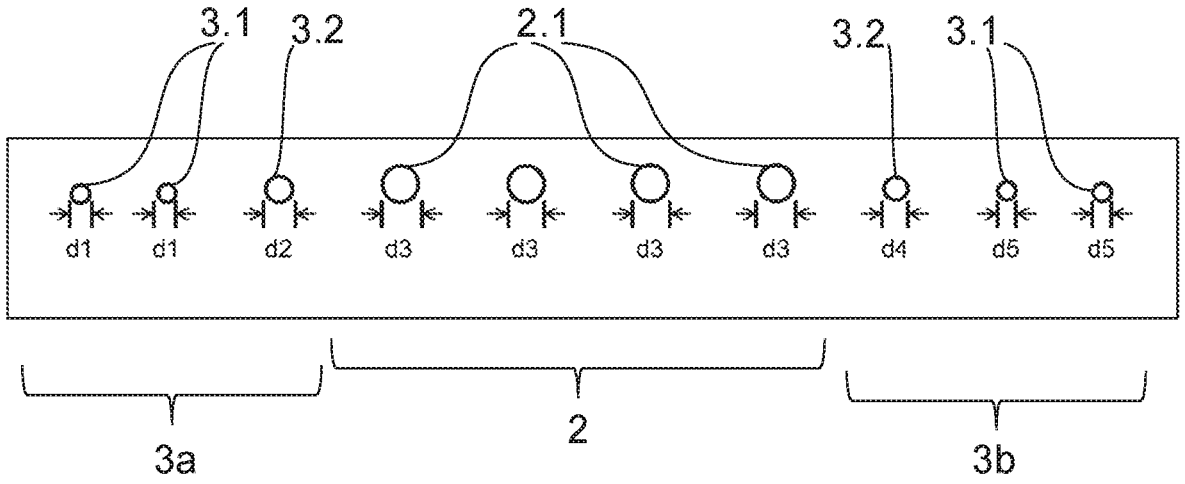
FIG. 4 shows a perforated plate with a row of nozzles according to a further example of the disclosure.

FIG. 4 shows a perforated plate 1 according to yet another example of the disclosure.

In the case of the perforated plate 1 shown in FIG. 4, the two edge regions 3*a* and 3*b* each comprise three through-holes 3.1 and 3.2, wherein the two outermost through-holes are provided with the reference sign 3.1 and the inner through-hole is provided with the reference sign 3.2. The two outermost through-holes 3.1 in the edge region 3*a* have a substantially equal-sized reference opening diameter d1, whilst the two outermost through-holes 3.1 in the edge region 3*b* also have a substantially equal-sized reference opening diameter d5. The through-hole 3.2 in the first edge region 3*a* has a reference opening diameter d2, whereas the through-hole 3.2 in the edge region 3*b* has a reference opening diameter d4. The through-holes 2.1 in the central region 2 have a substantially equal-sized reference opening diameter d3.

In the context of the disclosure, the reference opening diameters can be specified as follows:

d1 smaller than d2
d2 smaller than d3
d4 smaller than d3
d5 smaller than d4
d1 equal to or not equal to d5
d2 equal to or not equal to d4

Figure 5:
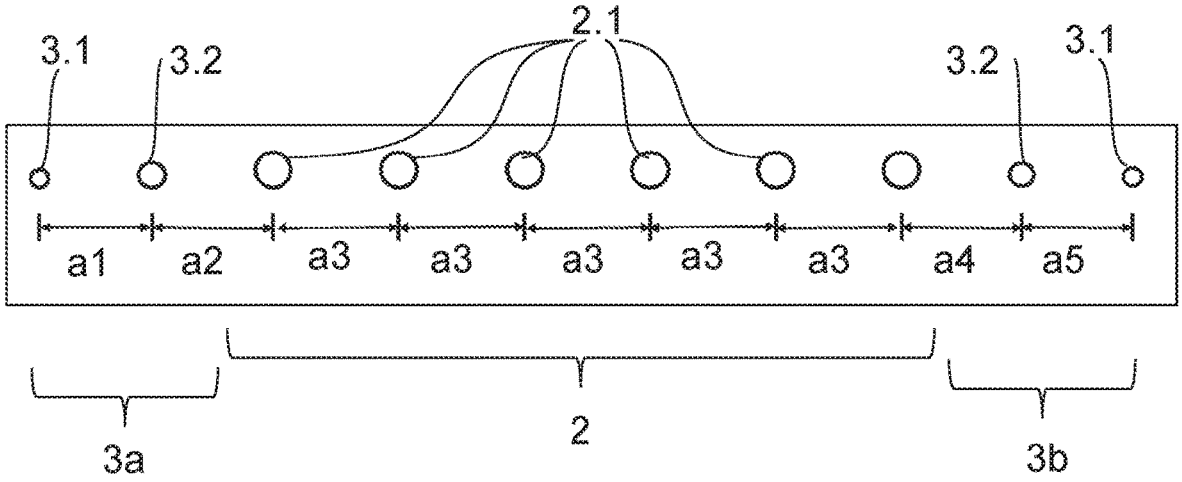
FIG. 5 shows a perforated plate with a row of nozzles according to yet another example of the disclosure.

FIG. 5 shows a perforated plate 1 according to another example of the disclosure.

The perforated plate 1 of FIG. 5 initially corresponds substantially to the perforated plate 1 of FIG. 2.

FIG. 5 serves, in particular, to illustrate possible through-hole spacing configurations of the row of nozzles.

In the context of the disclosure, the hole spacings can be specified, for example, as follows:

1.
a3 preferably uniform
a1 and a2 correspond to a3
a4 and a5 correspond to a3
2.
a3 preferably uniform
a1 and a2 equal-sized and a1 smaller than a3
a4 and a5 equal-sized and a4 smaller than a3
3.
a3 preferably uniform
a1 smaller than a2 and a2 smaller than a3 and/or
a5 smaller than a4 and a4 smaller than a3
4.
a3 preferably uniform
a1 and a2 equal-sized and a1 larger than a3 and/or
a4 and a5 equal-sized and a5 larger than a3
5.
a3 preferably uniform
a1 larger than a2 and a2 larger than a3 and/or
a5 larger than a4 and a4 larger than a3
6.
a3 preferably uniform
a1 not equal to a2 and a2 not equal to a3 and/or
a5 not equal to a4 and a4 not equal to a3

In principle, it is the case that the hole spacings in the two edge regions 3*a* and 3*b* can correspond to one another, e.g. a1 equal to a5 and a2 equal to a4, but can also be configured differently.

Figure 6A:
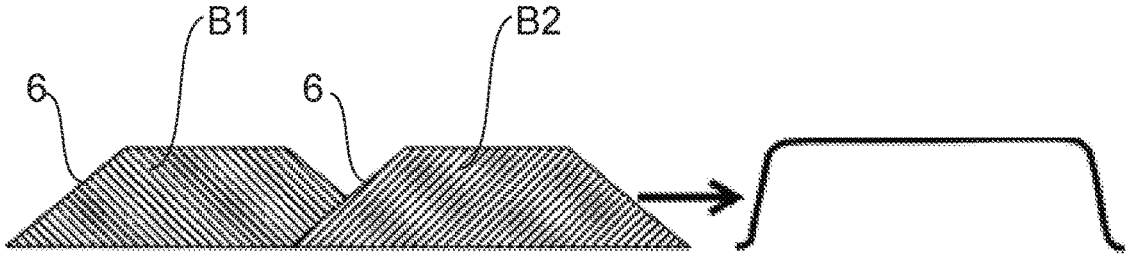
FIG. 6A shows a schematic cross-sectional representation of two fluid applications generated by means of an inventive perforated plate, according to one example of the disclosure.

FIG. 6A shows a schematic representation of the cross-section through two fluid tracks B1 and B2 which can be generated by means of a perforated plate 1 according to an example of the disclosure.

The cross-sections of the coating medium tracks B1 and B2 have a substantially isosceles trapezium form 6 and overlap in a joint or overlap region. The spacing tolerance between the two fluid tracks B1 and B2 can be in the range from +/−150 μm, +/−200 μm, +/−500 μm, +/−1 mm or even +/−2 mm. The trapezium form 6 leads to an optimum coating, as shown at right in FIG. 6A, in particular in the joint or overlap region.

Figure 6B:
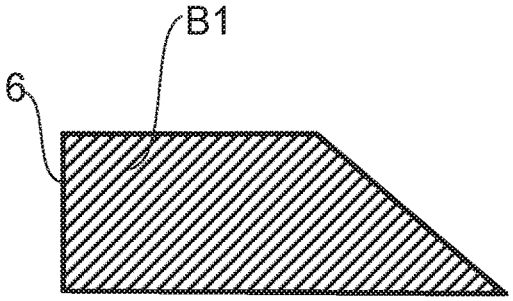
FIG. 6B shows a schematic cross-sectional representation of a fluid application generated by means of an inventive perforated plate, according to one example of the disclosure.

FIG. 6B shows a schematic representation of the cross-section of a fluid track B1, which can be generated by means of a perforated plate 1 according to an example of the disclosure. The cross-section has a substantially right-angled trapezium form 6.

The perforated plate 1 according to FIGS. 1 to 5 suitably serves for use with an application device for the application of a fluid. The application device can be configured to ensure a substantially equal-pressure inflow of the fluid over the entire row of nozzles, so that through the through-holes with a smaller diameter, as a result of the pressure loss, there flows a smaller fluid volume flow.

However, the application device can also be configured to enable a fluid inflow to the at least one edge region 3 that is controllable (e.g. regulable) independently of the central region 2.

The two edge regions 3*a* and 3*b* can be supplied with fluid e.g. by means of the same fluid delivery unit or each by its own fluid delivery unit.

FIGS. 7 to 12 illustrate through-hole configurations according to examples of the disclosure, according to which the respective through-holes 2.1, 3.1, 3.2 and 3.3 of the row of nozzles can be configured. The reference opening diameter is denoted in FIGS. 7 to 12 with the reference sign d and can relate to the respective through-holes 2.1, 3.1, 3.2 and 3.3 of the row of nozzles. The perforated plate 1 and, in particular, the through-holes can be configured as disclosed in WO 2014/121926 A1, so that the full content of this patent application is to be included in the present disclosure.

Figure 7:
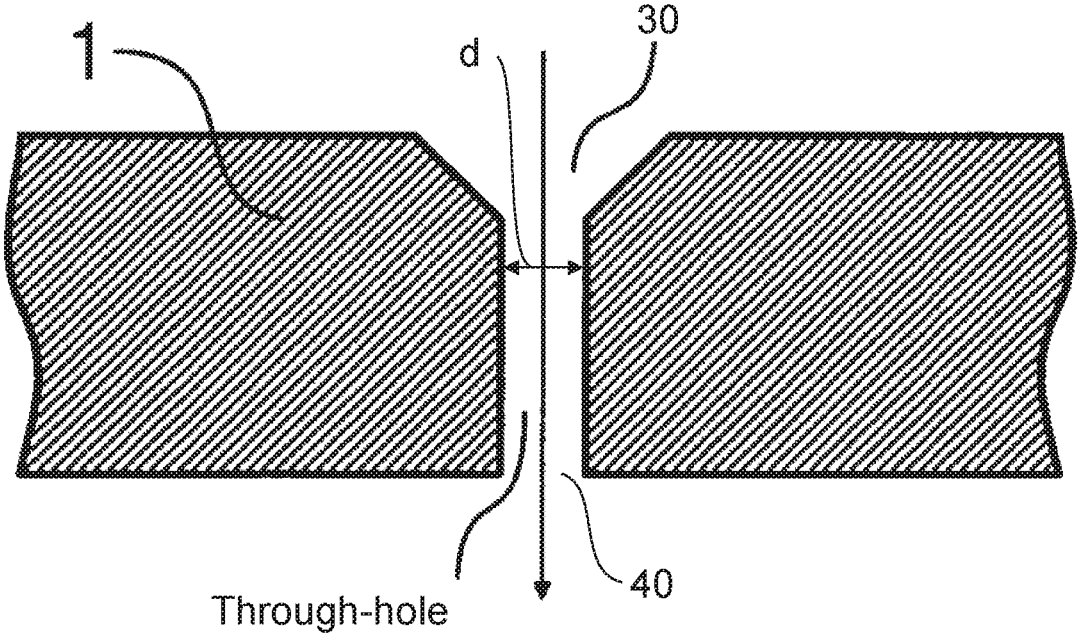
FIG. 7 shows a cross-sectional view through a through-hole of a perforated plate according to one example of the disclosure.

FIG. 7 shows a cross-sectional view through a perforated plate 1 in the region of one of the through-holes, wherein the arrow in the cross-sectional view indicates the flow direction of the coating medium through the through-hole. From the cross-sectional view, it is apparent that the through-hole has a fluidically optimised hole inlet 30, by means of which the flow resistance of the through-hole is reduced.

In addition, the perforated plate 1 has a structuring on the downstream side, on the peripheral edge of each through-hole, which reduces the wetting tendency.

Figure 8A:
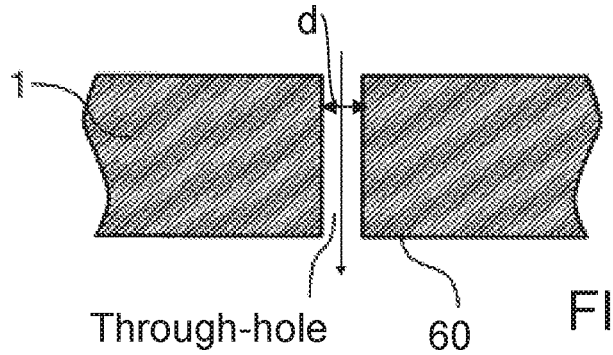
FIG. 8A shows a cross-sectional view through a through-hole of a perforated plate in another variant according to one example of the disclosure.
Figure 8B:
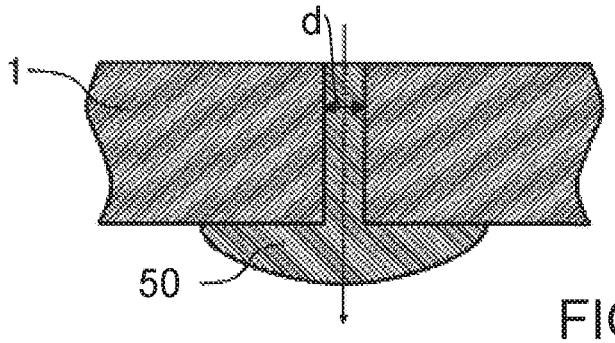
FIG. 8B shows the cross-sectional view of FIG. 8A with coating medium in the through-hole.
Figure 9A:
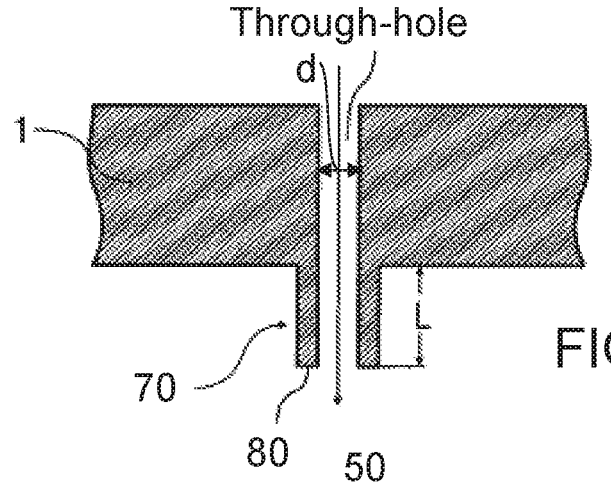
FIG. 9A shows a derivation of FIG. 8A with an additional pipe stub for lessening the wetting surface area according to another example of the disclosure.
Figure 9B:
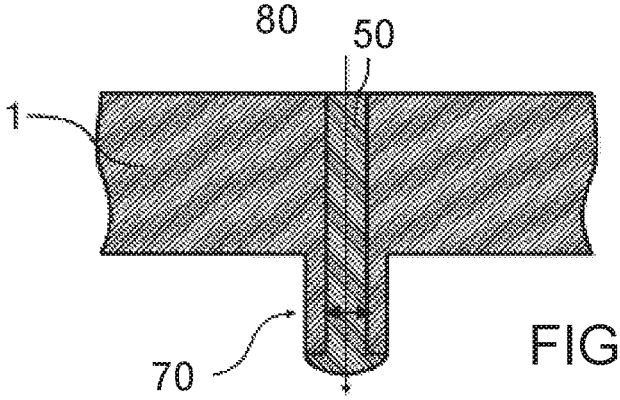
FIG. 9B shows the cross-sectional view of FIG. 9A with coating medium in the through-hole.

FIGS. 8A and 9B show an alternative cross-sectional view through the perforated plate 1 in the region of a through-hole, wherein FIG. 8A shows the through-hole without coating medium, while FIG. 9B shows a coating medium (e.g. fluid) 50.

It is evident from this that the coating medium 50 wets a wetting surface 60 on the downstream surface of the perforated plate 1, which impedes a jet-shaped release of the coating medium 50 from the perforated plate 1.

FIGS. 9A and 9B show a preferred example of the disclosure with a reduced wetting tendency. For this, the perforated plate 1 has a pipe stub 70 on the peripheral edge of each individual through-hole, wherein the through-hole transitions into the pipe stub 70 so that at the free end of the pipe stub 70, the end face of the pipe stub 70 forms a wetting surface 80. The wetting surface 80 is thus restricted to the free end face of the pipe stub 70 and hence substantially smaller than the wetting surface 60 in FIG. 8A. This facilitates the release of the coating medium 50 from the perforated plate 1.

Between the downstream side of the perforated plate 1 and the free end of the pipe stub 70, the pipe stub 70 has for example a length L which is preferably greater than 50 μm, 70 μm, or 100 μm and/or less than 200 μm, 170 μm or 150 μm, so that the pipe stub 70 may have e.g. a length L of between 50 to 200 μm, 70 to 170 μm or 100 to 150 μm.

Figure 10:
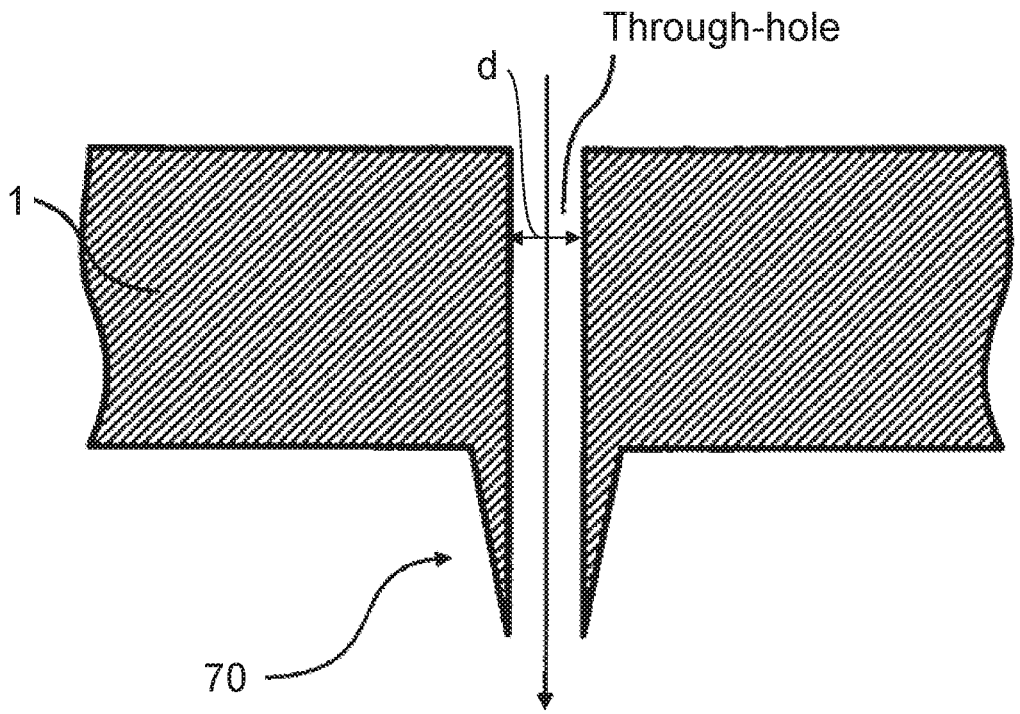
FIG. 10 shows a derivation of FIG. 9A with a conically tapering pipe stub according to another example of the disclosure.

FIG. 10 shows a derivative of FIG. 9A, wherein the outer casing surface of the pipe stub 70 tapers conically towards the free end of the pipe stub 70, so that the wetting surface at the free end of the pipe stub 70 is minimal.

Figure 11A:
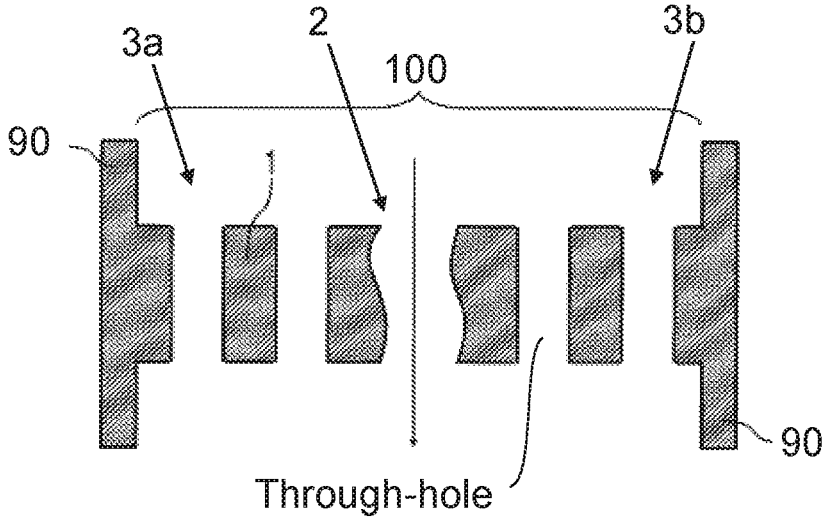
FIG. 11A shows a schematic cross-sectional view through a perforated plate with a reinforced edge and a thinner central region with the through-holes according to another example of the disclosure.

FIG. 11A shows a schematic cross-sectional view through a perforated plate 1 which partially correlates with the perforated plates described above, so to avoid repetition, reference is made to the description above, wherein the same reference signs are used for corresponding details.

One particular feature of this exemplary example is that the perforated plate 1 has a relatively thick edge 90 on the outside, and a thinner region 100 with the through-holes in the middle. The thick edge 90 of the perforated plate 1 here ensures adequate mechanical stability, while the reduction in thickness in the region 100 with the through-holes ensures that the through-holes offer only a relatively low flow resistance.

Figure 11B:
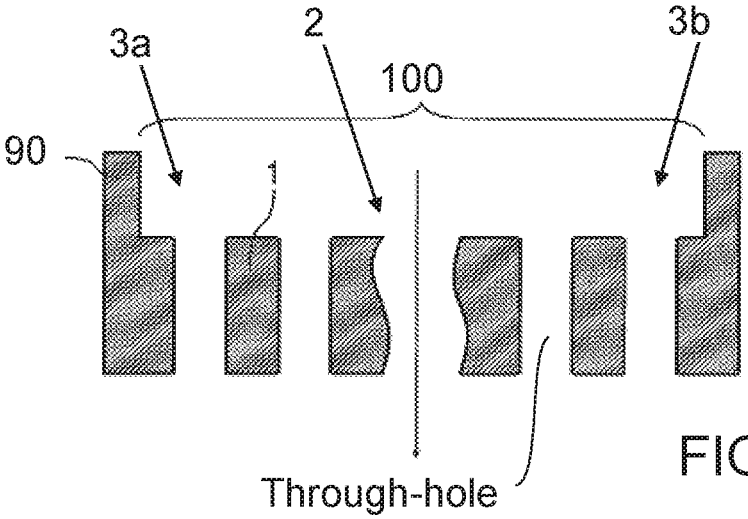
FIG. 11B shows a derivation of FIG. 11A according to another example of the disclosure.

FIG. 11B shows a derivative of FIG. 11A, so to avoid repetition, reference is made to the description of FIG. 11A, wherein the same reference signs are used for corresponding details.

A particular feature of this exemplary example is that the region 100 is here reduced in thickness on one side only.

The sharp edges and corners shown in the figures are depicted merely as examples and may advantageously also be rounded in order to configure them fluidically optimised or to achieve better rinsability.

Figure 12:
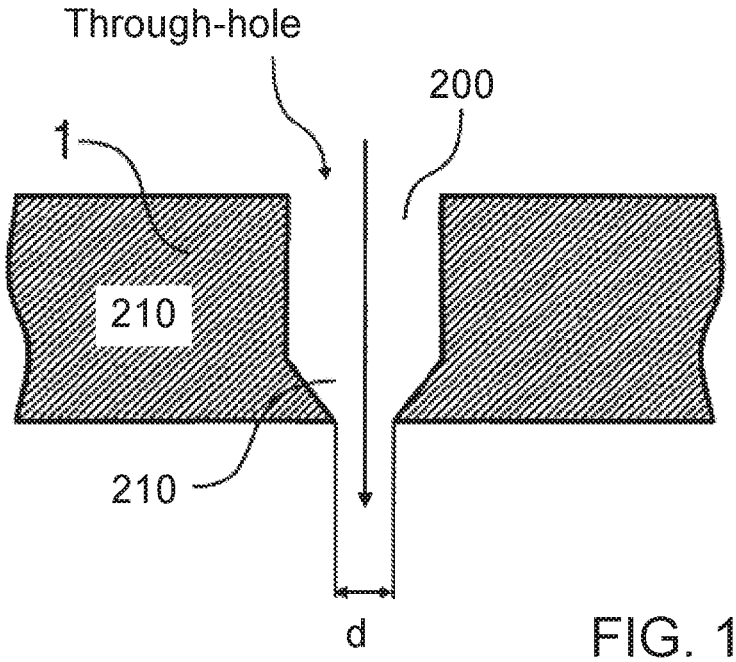
FIG. 12 shows a derivation of FIG. 7 according to another example of the disclosure.

A particular feature of the exemplary example of the through-hole shown in FIG. 12 is that at the upstream hole inlet opening, the through-hole firstly has a cylindrical region 200 with a first inner diameter.

Then, in the flow direction, the cylindrical region 200 is followed by a conical region 210 which tapers in the flow direction and has the reference opening diameter (inner diameter) d at the hole outlet opening.

It is important here that the reference opening diameter (inner diameter) d of the hole outlet opening is preferably substantially smaller than the first inner diameter of the cylindrical region 200.

Figure 13A:
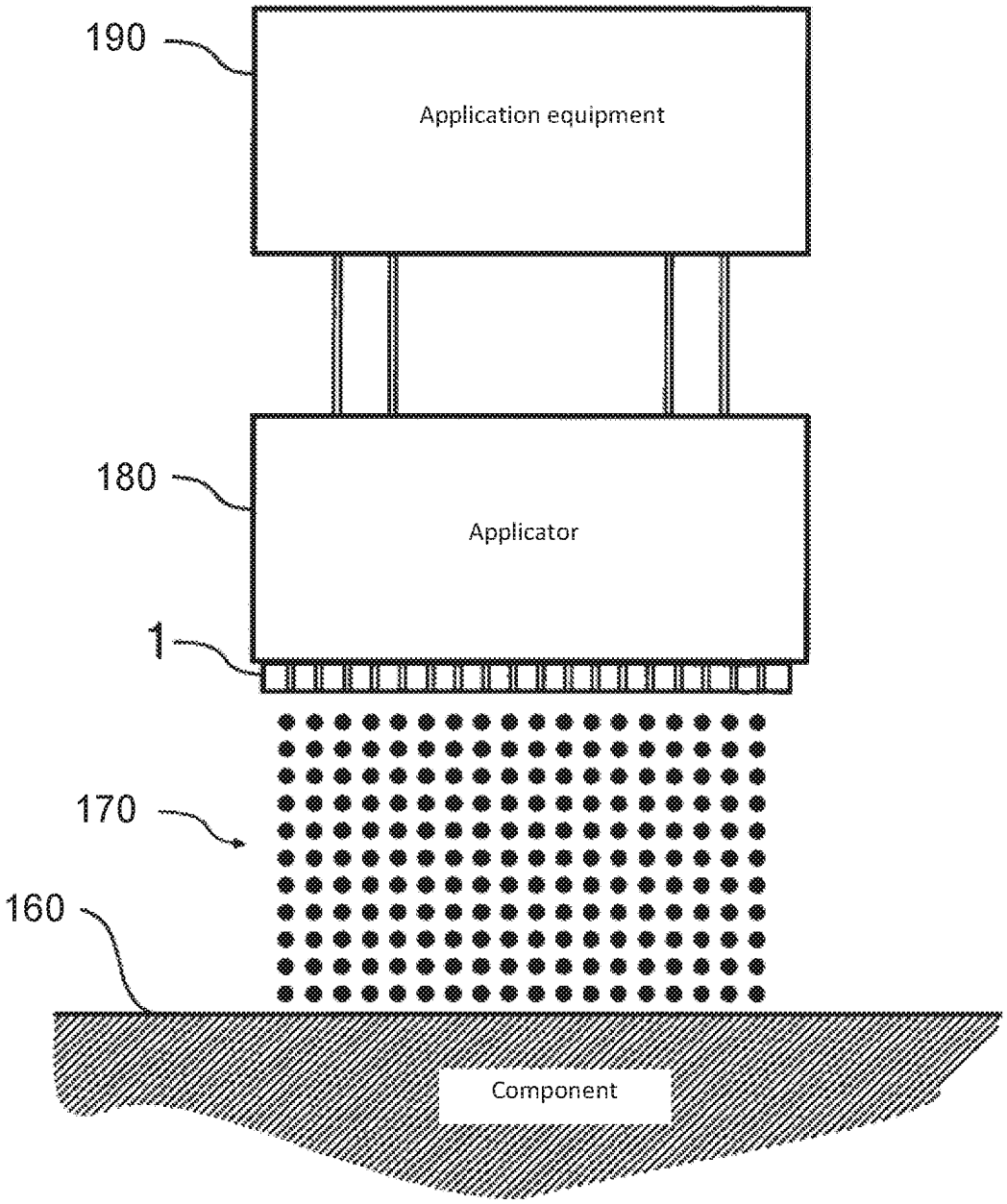
FIG. 13A shows an application device (applicator) with a perforated plate according to one example of the disclosure.

FIG. 13A shows in highly simplified schematic depiction an application device, in particular an applicator, with a perforated plate 1 according to the disclosure for coating a component 160 (e.g. a motor vehicle body component).

Jets 170 of coating medium here emerge from the individual through-holes of the perforated plate 1 and form a cohesive film of coating medium on the surface of the component 160. The individual jets 170 of coating medium may be formed as droplet jets as shown in FIG. 13A, or as cohesive jets of coating medium, in particular without forming droplets, as shown in FIG. 13B.

Figure 13B:
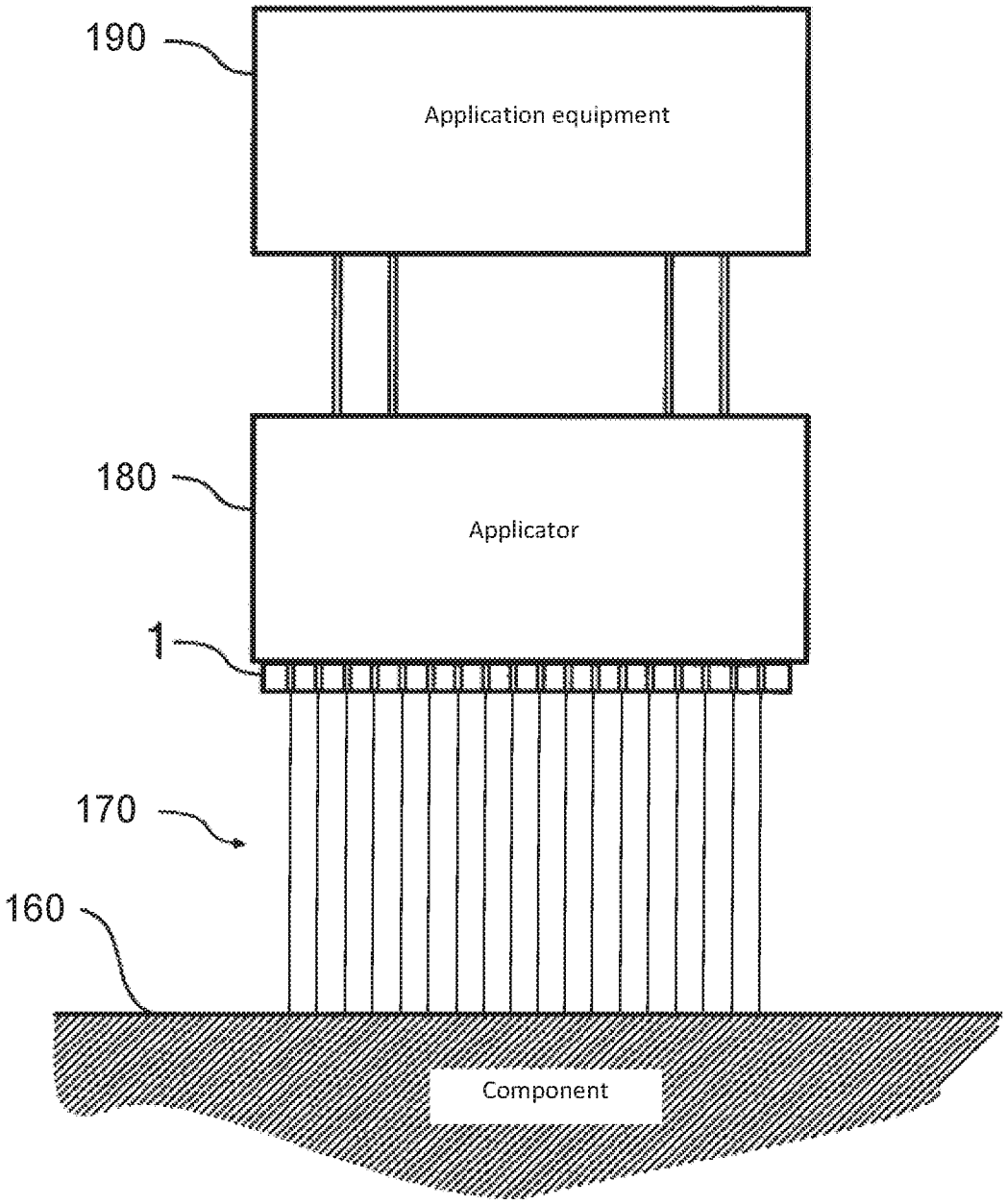
FIG. 13B shows an application device (applicator) according to another example of the disclosure.

Furthermore, FIGS. 13A and 13B show an applicator 180 connected to the perforated plate 1, and an application equipment 190 which is connected to the applicator 180 by schematically depicted lines.

Figure 14:
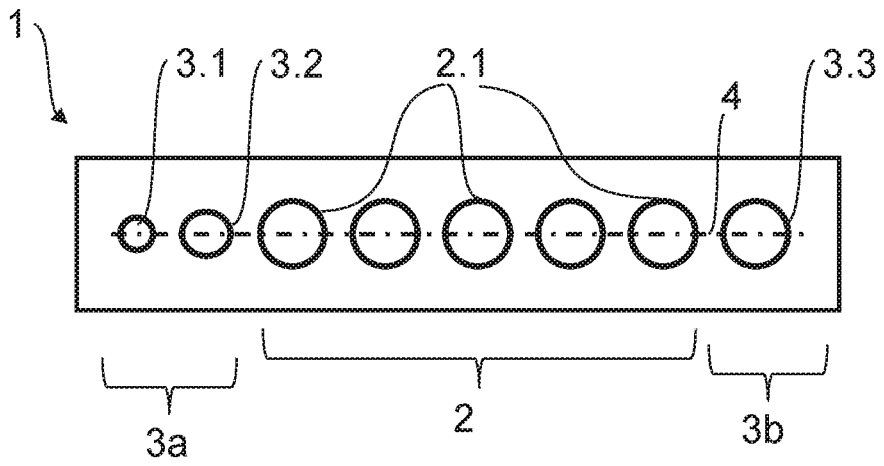
FIG. 14 shows a perforated plate with a row of nozzles according to one example of the disclosure.
Figure 15:
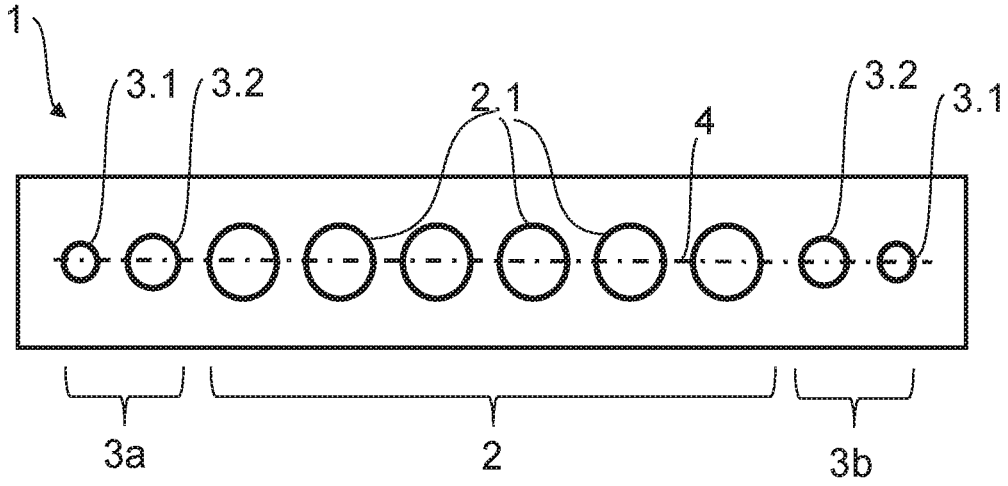
FIG. 15 shows a perforated plate with a row of nozzles according to another example of the disclosure.
Figure 16:
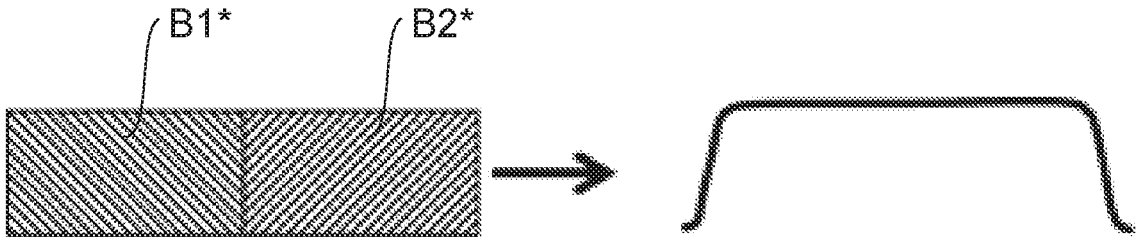
Prior art FIG. 16
FIG. 16 shows two coating medium tracks according to the prior art.
Figure 17:
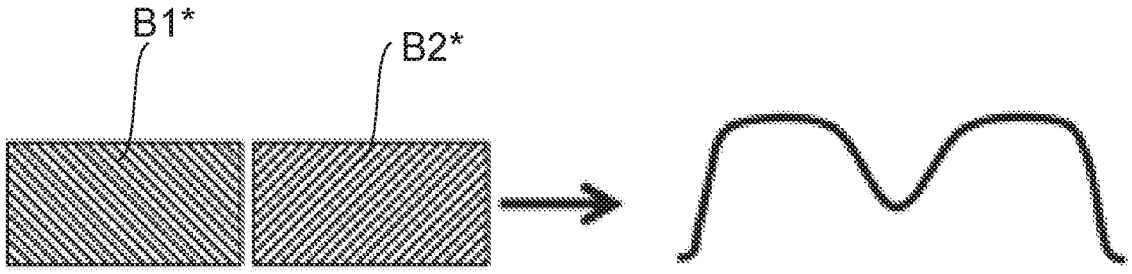
Prior art FIG. 17
FIG. 17 shows two coating medium tracks according to the prior art.
Figure 18:
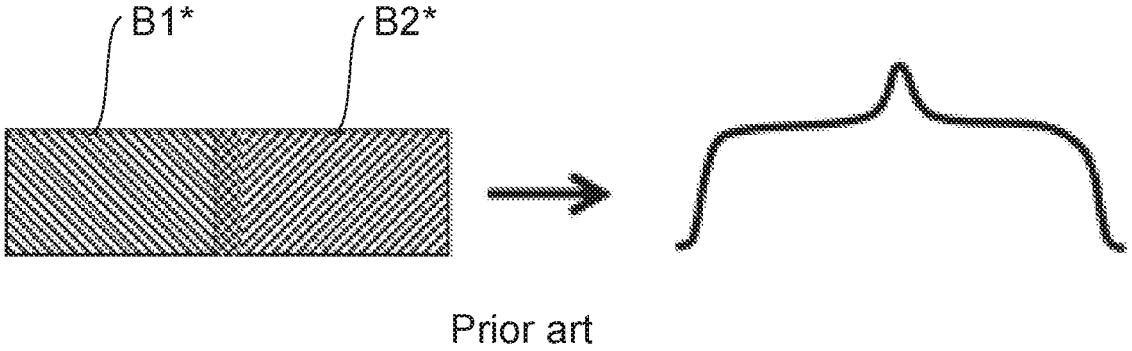
FIG. 18 shows two coating medium tracks according to the prior art.

FIGS. 14 and 15 show perforated plates 1 with a linearly oriented row of nozzles comprising the central region 2 and at least one edge region 3*a*, according to two examples of the disclosure.

A peculiarity of the perforated plate 1 shown in FIG. 14 is that the central axes of the through-holes 2.1, 3.1, 3.2 and 3.3 are substantially aligned on the straight alignment line 4. Thus, a straight alignment line 4 extends linearly through the central axes of the through-holes 3.1 and 3.2 in the edge region 3*a*, through the central axes of the through-holes 2.1 in the central region 2 and through the central axis of the through-hole 3.3 in the edge region 3*b*, so that a central nozzle row alignment comes about between the central region 2 on one hand and the two edge regions 3*a* and 3*b* on the other hand.

FIG. 14 further shows that the perforated plate 1 is arranged on an outer end side of the application device, so that the at least three through-holes 2.1, 3.1, 3.2, 3.3 form exit holes from the application device.

A peculiarity of the perforated plate 1 shown in FIG. 15 is that the central axes of the through-holes 2.1, 3.1 and 3.2 are substantially aligned on the straight alignment line 4. Thus, a straight alignment line 4 extends linearly through the central axes of the through-holes 3.1 and 3.2 in the edge region 3*a*, through the central axes of the through-holes 2.1 in the central region 2 and through central axes of the through-holes 3.1 and 3.2 in the edge region 3*b*, so that a central nozzle row alignment comes about between the central region 2 on one hand and the two edge regions 3*a* and 3*b* on the other hand.

It should be mentioned that the rows of nozzles shown in FIGS. 1 to 5 and 14 and 15 are all aligned linearly, wherein in FIGS. 1 to 5, preferably all the through-holes are linearly aligned with their reference and/or hole outlet opening diameters, whereas in FIGS. 14 and 15, preferably all the through-holes are linearly aligned with their central axes.

Figure 19:
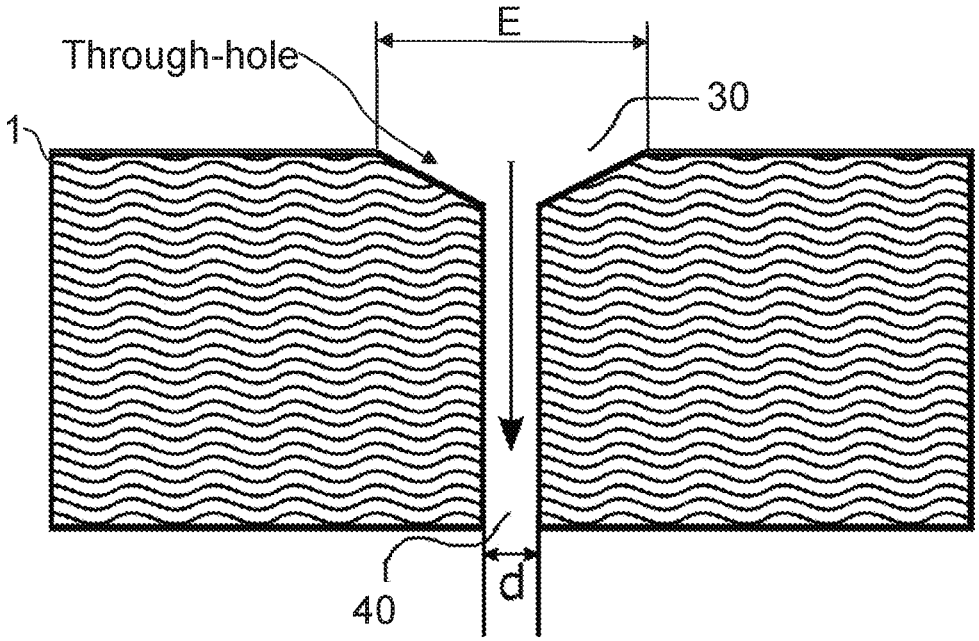
FIG. 19 shows a cross-sectional view through a through-hole of a perforated plate according to one example of the disclosure.

FIG. 19 shows a cross-sectional view through a through-hole of a perforated plate 1 according to one example of the disclosure. The through-hole comprises a hopper-shaped hole inlet opening 30 with an inlet cross-section E and a cylindrical hole outlet opening 40.

Figure 20:
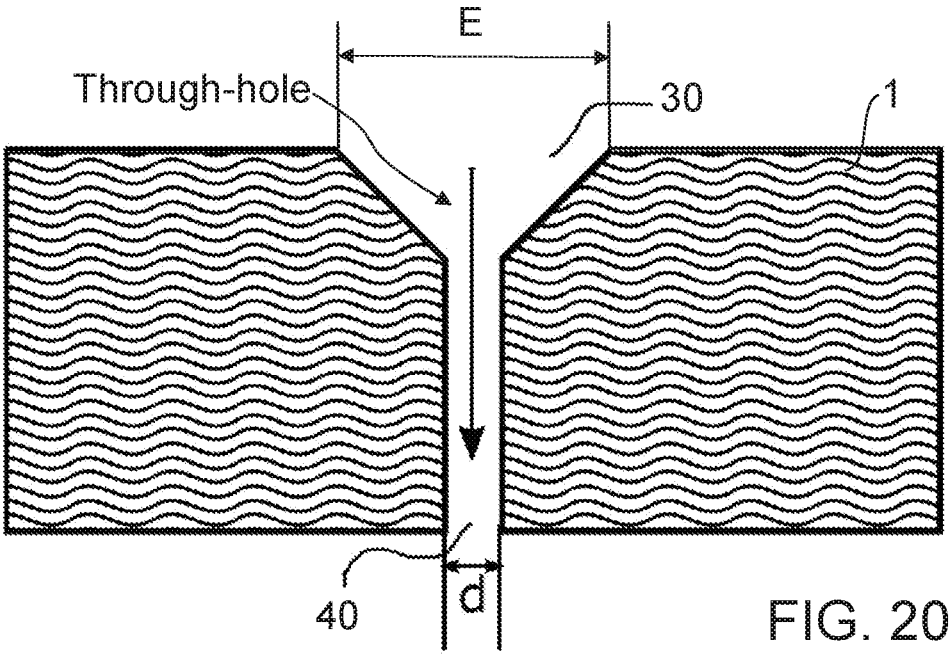
FIG. 20 shows a cross-sectional view through a through-hole of a perforated plate according to another example of the disclosure.

FIG. 20 shows a cross-sectional view through a through-hole of a perforated plate 1 according to another example of the disclosure. The through-hole comprises a hopper-shaped hole inlet opening 30 with an inlet cross-section E and a cylindrical hole outlet opening 40, wherein the hopper-shaped hole inlet opening 30 of FIG. 20 extends more deeply into the perforated plate 1 than the hopper-shaped hole inlet opening 30 of FIG. 19.

Figure 21:
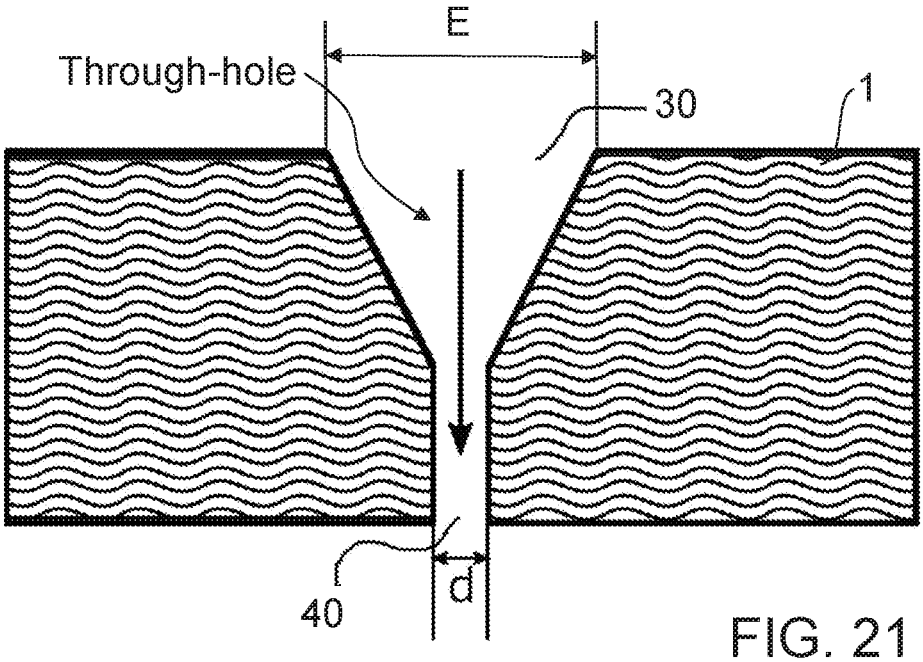
FIG. 21 shows a cross-sectional view through a through-hole of a perforated plate according to a further example of the disclosure.

FIG. 21 shows a cross-sectional view through a through-hole of a perforated plate 1 according to another example of the disclosure. The through-hole comprises a hopper-shaped hole inlet opening 30 with an inlet cross-section E and a cylindrical hole outlet opening 40, wherein the hopper-shaped inlet opening 30 in FIG. 21 extends more deeply into the perforated plate 1 than the hopper-shaped hole inlet opening 30 in FIG. 20.

Figure 22:
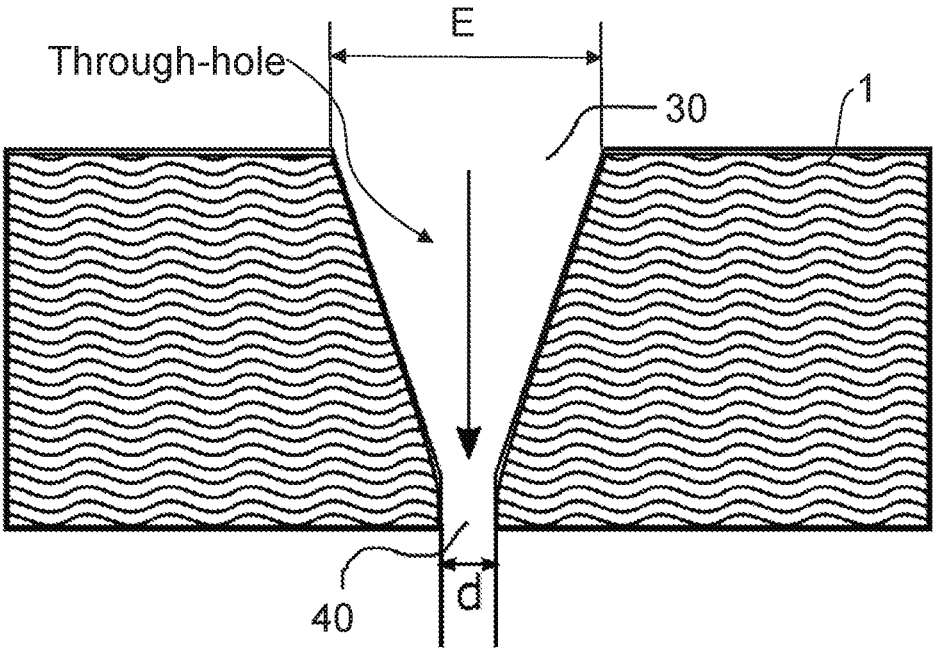
FIG. 22 shows a cross-sectional view through a through-hole of a perforated plate according to yet another example of the disclosure.

FIG. 22 shows a cross-sectional view through a through-hole of a perforated plate 1 according to another example of the disclosure. The through-hole comprises a hopper-shaped hole inlet opening 30 with an inlet cross-section E and a cylindrical hole outlet opening 40, wherein the hopper-shaped inlet opening 30 in FIG. 22 extends more deeply into the perforated plate 1 than the hopper-shaped hole inlet opening 30 in FIG. 21.

FIGS. 19 to 22 in particular show an additional possibility for influencing the fluid flow by changing the cylindrical proportion of a through-hole, in that its hole inlet opening 30 is configured hopper-shaped. By providing a hopper-shaped hole inlet opening 30 so that the cylindrical proportion of the through-hole can be reduced or enlarged, the fluid volume flow through the through-hole may be increased or reduced further, although for example in FIGS. 19 to 22 the reference opening diameters d and the inlet cross-sections E are the same size. FIG. 19 here allows the smallest, FIG. 20 the second smallest, FIG. 21 the third smallest and FIG. 22 the largest fluid volume flow.

The through-holes shown in FIGS. 19 to 22 may suitably be used in the central region 2 of the nozzle row and/or in at least one edge region 3*a*, 3*b* of the nozzle row.

It must also be mentioned that an application device according to an example of the disclosure may comprise at least two perforated plates 1 arranged next to each other, the nozzle rows of which are arranged offset to each other in the longitudinal direction of the nozzle rows. The perforated plates 1 here are arranged on an outer end face of the application device so they constitute outer plates.

The invention claimed is:

1. An application device for application of a fluid without atomization of the fluid, the fluid being one of a paint, a sealant, a separating agent, or an adhesive, the application device, comprising:

a perforated plate for application of the fluid onto a component without atomization of the fluid, the perforated plate having at least three through-holes for passage of the fluid, wherein the at least three through-holes are assigned to a row of nozzles with a central region and two edge regions, each of the at least three through-holes defining an axis, the axes linearly aligned and parallel to each other, wherein at least one outermost through-hole of the at least three through-holes is in at least one of the two edge regions and has at least one reference opening diameter that is smaller than at least one reference opening diameter of at least one through-hole in the central region of the at least three through-holes assigned to the row of nozzles, wherein at least two outermost through-holes in one edge region have different reference opening diameters than each other, and the reference opening diameters of the at least two outermost through-holes in the one edge region are smaller than reference opening diameters of the through-holes of the central region, wherein each through-hole of the at least three through-holes has a hopper shaped hole inlet opening, the hopper shaped hole inlet openings of the at least three through-holes all being a different depth relative to each other, and wherein an edge of the perforated plate is thicker along the axis than at the through-holes along the axis.

2. The application device according to claim 1, wherein the perforated plate has only one single row of nozzles for the application of the fluid.

3. The application device according to claim 1, wherein the row of nozzles comprising the central region and at least one edge region is aligned linearly.

4. The application device according to claim 1, wherein a straight alignment line extends linearly through at least one central axis of the at least one outermost through-hole in at least one edge region and through at least one central axis of at least one through-hole in the central region, so that a central nozzle row alignment comes about between the at least one edge region and the central region.

5. The application device according to claim 1, wherein the reference opening diameter of an outermost through-hole of the at least two outermost through-holes is smaller than the reference opening diameter of the other of the at least two outermost through-holes.

6. The application device according to claim 1, wherein the central region has one of: at least two and at least three through-holes.

7. The application device according to claim 1, wherein a plurality of through-holes in the central region have a uniform reference opening diameter, and the central axes of a plurality of through-holes in the central region are aligned linearly to one another.

8. The application device according to claim 1, wherein a plurality of through-holes in the central region are spaced equally from one another.

9. The application device according to claim 1, wherein one of: an outermost hole spacing and at least two outermost hole spacings in at least one edge region correspond to the at least one hole spacing in the central region.

10. The application device according to claim 1, wherein at least one outermost hole spacing in one edge region of the row of nozzles is configured uniform relative to at least one outermost hole spacing in the other edge region.

11. The application device according to claim 1, wherein at least one hole spacing and the reference opening diameters in the two edge regions correspond to one another.

12. The application device according to claim 1, wherein the row of nozzles is formed at least one of axially symmetrically and mirror symmetrically, relative to a symmetry axis running transversely to the row of nozzles.

13. The application device according to claim 1, wherein the through-holes of the row of nozzles each have a hole inlet opening on the upstream side of the perforated plate and a hole outlet opening on the downstream side of the perforated plate and a pipe stub as a three-dimensional structuring on the downstream side of the perforated plate, wherein the hole inlet openings have a larger passage cross-section than the hole outlet openings.

14. The application device according to claim 13, wherein the pipe stubs have an outer casing surface which tapers toward the free end of the respective pipe stub.

15. The application device according to claim 1, wherein the at least one outermost through-hole in one edge region has at least one reference opening diameter that is smaller than at least one reference opening diameter of at least one through-hole in the central region, and the at least one outermost through-hole in the other edge region has at least one reference opening diameter which is uniformly configured to at least one reference opening diameter of at least one through-hole in the central region.

16. The application device according to claim 1, wherein the perforated plate includes a flange at the edge.

17. The application device according to claim 16, wherein the perforated plate includes a second flange opposite the flange, and wherein the flange extends upward and the second flange extends downward.

18. The application device according to claim 1, wherein at least two outermost through-holes of the at least three through-holes in the other edge region have different reference opening diameters than each other, and the reference opening diameters of the at least two outermost through-holes of the other edge region are smaller than reference opening diameters of the through-holes of the central region.

19. The application device according to claim 18, wherein an outermost through-hole of the at least two outermost through-holes at each of the edge regions is smaller than the reference opening diameter of the other of the at least two outermost through-holes.

20. The application device according to claim 19, wherein the reference opening diameters of the through-holes of the central region are all uniform in size.

21. The application device according to claim 20, wherein the at least two through-holes of one of the edge regions is formed symmetrically to the at least two through-holes of the other of the edge regions.

* * * * *